US008225422B1

(12) United States Patent
McSparron

(10) Patent No.: US 8,225,422 B1
(45) Date of Patent: Jul. 24, 2012

(54) CAR SEAT COAT

(76) Inventor: Erin J. McSparron, Grand Forks, ND (US)

( * ) Notice: Subject to any disclaimer, the term of this patent is extended or adjusted under 35 U.S.C. 154(b) by 461 days.

(21) Appl. No.: 12/253,486

(22) Filed: Oct. 17, 2008

Related U.S. Application Data

(60) Provisional application No. 60/999,407, filed on Oct. 18, 2007.

(51) Int. Cl.
*A41B 13/06* (2006.01)

(52) U.S. Cl. ..... 2/67; 2/69.5

(58) Field of Classification Search ..... 2/111, 80, 2/75, 69.5, 86, 88, 89, 97, 84, 206; 5/413 R
See application file for complete search history.

(56) References Cited

U.S. PATENT DOCUMENTS 2,316,983 A * 4/1943 Wulf ..... 2/97
2,462,165 A * 2/1949 Condon ..... 2/69.5
2,469,556 A * 5/1949 Jacobson ..... 2/83
2,534,978 A * 12/1950 Lapedes ..... 2/97
2,738,512 A * 3/1956 Winer ..... 2/80
2,932,827 A 4/1960 Munro, Jr.
4,103,361 A * 8/1978 Carmen ..... 2/97
4,125,903 A 11/1978 Farrell
4,178,637 A * 12/1979 Wrightson ..... 2/69.5
4,241,458 A 12/1980 Lesesne
4,304,006 A * 12/1981 Swart ..... 2/49.1
D269,475 S 6/1983 Albertson
4,611,353 A * 9/1986 Als et al. ..... 2/69
4,715,068 A * 12/1987 Jacobson ..... 2/272
D296,378 S 6/1988 Coates
4,773,101 A * 9/1988 Kapp et al. ..... 2/69.5
4,811,429 A * 3/1989 Perez ..... 2/83
4,901,371 A * 2/1990 Christians ..... 2/69.5
4,999,850 A * 3/1991 Grilliot et al. ..... 2/126
5,023,952 A 6/1991 Palmer
5,046,204 A 9/1991 Mohler
5,131,096 A * 7/1992 Olson ..... 2/75
5,542,123 A * 8/1996 DiPietro ..... 2/80
D380,589 S * 7/1997 Westman ..... D2/719
5,781,946 A * 7/1998 McEntire et al. ..... 5/482
D399,676 S 10/1998 Gerlach
D400,688 S * 11/1998 Federspiel ..... D2/719
5,845,340 A * 12/1998 Frislie ..... 2/202
5,875,492 A * 3/1999 Moss ..... 2/93
5,897,164 A 4/1999 Kagan et al.
5,918,314 A * 7/1999 Moses ..... 2/79
5,924,129 A * 7/1999 Gill ..... 2/10
5,950,261 A 9/1999 Hay et al.
6,012,189 A 1/2000 Dudley
6,029,278 A * 2/2000 Lopez ..... 2/209.13
6,036,260 A 3/2000 Mullen
6,055,686 A 5/2000 Knight
(Continued)

*Primary Examiner* — Alissa L Hoey
(74) *Attorney, Agent, or Firm* — Brian C. Trask

(57) ABSTRACT

Clothing adapted for a child to wear while traveling in a car seat. The clothing includes sleeves, legs, and a hood connected to a back panel to form an always-open area over the child's chest. The always-open area avoids trapping material of the clothing between seat belt straps and the child's chest. Certain embodiments include a blanket that is sized to form a covering over the always-open area. Desirably, the blanket is optionally removable, to permit its use for other functions. When present, it is currently preferred for an edge of the blanket to be affixed to a visor of the hood. The distal ends of sleeves and legs in certain embodiments are permanently closed. In other cases, the ends may be optionally closed, or structured to remain open-ended. The clothing may include a plurality of layers to provide variable insulation.

17 Claims, 5 Drawing Sheets

U.S. PATENT DOCUMENTS

| | | | | |
|---|---|---|---|---|
| 6,145,932 | A | 11/2000 | Hamel-Nyhus et al. | |
| 6,266,822 | B1 * | 7/2001 | Joyce | 2/83 |
| 6,334,221 | B1 * | 1/2002 | Hope | 2/69.5 |
| 6,394,543 | B1 | 5/2002 | Dunne et al. | |
| 6,408,439 | B1 * | 6/2002 | Garforth-Crippen | 2/80 |
| 6,547,325 | B2 | 4/2003 | Drost et al. | |
| D477,744 | S | 7/2003 | Kelly | |
| 6,665,878 | B1 * | 12/2003 | Way | 2/84 |
| D484,672 | S | 1/2004 | McCray | |
| 6,782,560 | B1 * | 8/2004 | Ascherl et al. | 2/456 |
| 6,817,033 | B2 * | 11/2004 | Bailey | 2/69.5 |
| 6,948,200 | B2 | 9/2005 | Wyman | |
| D518,942 | S | 4/2006 | Dandrea | |
| 7,065,810 | B2 | 6/2006 | Robinson | |
| 7,178,185 | B1 * | 2/2007 | Nattler | 5/482 |
| D555,409 | S | 11/2007 | Wescott | |
| D556,491 | S | 12/2007 | Simpson et al. | |
| D562,612 | S | 2/2008 | Simpson et al. | |
| 7,409,726 | B2 * | 8/2008 | Bahm et al. | 2/49.1 |
| 7,409,729 | B2 * | 8/2008 | Bahm et al. | 2/111 |
| 7,530,118 | B2 * | 5/2009 | Osborne et al. | 2/69.5 |
| D612,579 | S * | 3/2010 | Dickinson | D2/719 |
| 2003/0079270 | A1 * | 5/2003 | Bailey | 2/69.5 |
| 2004/0019969 | A1 * | 2/2004 | Gatten | 5/482 |
| 2005/0125895 | A1 * | 6/2005 | Gatten | 5/482 |
| 2006/0185055 | A1 * | 8/2006 | DeWitt | 2/111 |
| 2007/0044199 | A1 * | 3/2007 | Ebert | 2/111 |
| 2007/0056098 | A1 * | 3/2007 | Schmid et al. | 5/482 |
| 2008/0196141 | A1 * | 8/2008 | Osborne et al. | 2/111 |
| 2009/0249526 | A1 * | 10/2009 | Carangelo | 2/69.5 |

* cited by examiner

CAR SEAT COAT

RELATED APPLICATIONS

This application claims the benefit under 35 U.S.C. 119(e) of the filing date of Provisional Application Ser. No. 60/999,407, filed Oct. 18, 2007, for "CAR SEAT COAT", the entire disclosure of which is hereby incorporated as though set forth herein in its entirety.

BACKGROUND

1. Field of the Invention

This invention relates to clothing items for children. It is particularly directed to an insulating layer of clothing adapted to be worn by a child that is riding in a car safety seat during cold weather.

2. State of the Art

It is generally recognized that, for safety, infants and small children must be confined to a car seat that is specially adapted for their size when being transported in an automobile. Typically, the child is restrained in the car seat by a safety seatbelt harness system including a number of straps and a releasable strap-fastening system, such as one or more buckle or catch mechanism. During cold weather, it is sometimes desirable to provide a garment forming an additional layer of insulation to augment a child's clothing when riding in a car seat, or when transporting the child from a warm environment to the automobile. Accordingly, a plurality of insulating garments adapted to accommodate a child in a car seat are commercially available. However, the strap system of a car seat imposes safety, comfort, and convenience considerations that are not addressed by certain commercially available insulating garments.

For example, Bundle Me by JJ Cole is not safe according to Car Seat Safety Technicians because the layer under the child is too thick and the openings for the car seat straps alter the angle of the shoulder straps so that when used, the child is not properly restrained. It is made to remain in the car seat so it does not offer a way to completely protect the child from the elements when transporting to and from the car. It also leaves the child completely exposed to the elements while buckling them in their seat.

Further, Teddy Toes by Sisters 3 does not offer a way to completely protect the child from the elements when transporting them to and from the car, is only one layer so not warm enough for cold temperatures, and the child is left completely exposed while buckling them in their seat.

Also, Honu Wrap by Baby Polar Gear does not offer a way to completely protect the child from the elements when transporting them to and from the car, is only one layer so is not warm enough for cold temperatures, and car seat straps must be donned over top of the coat making it unsafe in the car seat and not allowing heat regulation once strapped into the car seat. It also only has two sizes available, 0-3 and 3-6 months.

Finally, North Star Baby Bunting does not offer a way to completely protect the child from the elements when transporting them to and from the car (has only a small flap to cover the face), is only one layer so is not warm enough for cold temperatures, car seat straps must be donned over top of the coat making it unsafe in the car seat and not allowing heat regulation once strapped into the car seat and the star shape adds bulk and does not hold the limbs securely in their place. Also, only two sizes are available, small and large.

Children being taken in and out of the car need to be protected from bitter wind and temperatures. Current products on the market that are safe in the car seat are not thick enough and do not provide a way to shield the child's face from these elements. Parents often try to cover a child with a blanket when going to and from the car, but this can be a huge hassle. The blanket can fall on the ground, be pushed away by the child, and be hard to place to provide complete coverage. Products such as snowsuits can keep the child warm, but are unsafe when used in a car seat. A snowsuit offers resistance across the chest when tightening the straps but in a crash can compress with such force that a child would not be retained properly and could be ejected from the seat.

It would be an improvement to provide a car seat coat that offers a way to keep the child protected when going to and from the car while avoiding necessity to also transport the car seat, allows the child to remain covered while being strapped into the car seat, ensures that the child is properly restrained by not inherently altering the natural angle of the car seat's shoulder straps, and is sufficiently warm to protect against frigid temperatures without being so bulky and compressible as to fail to properly retain a child in the car seat in event of a crash. It would be a further improvement to provide a car seat coat having capability to adjust its inherent insulating ability. It would be a further improvement to provide a car seat coat that permits a more broad range of temperature regulation for a child by permitting variable installation of the child into the car seat coat, and by permitting different configurations providing a plurality of amounts of wrapping of the child.

BRIEF SUMMARY OF THE INVENTION

A currently preferred embodiment of this invention provides a full body fleece coat made for a baby or a toddler that is approved by Certified Car Seat Safety Technicians. It comes with two main parts, a body (or jump-suit) and a blanket, that work together to provide full body protection from the elements. The body of the currently preferred embodiment has a full back, sleeves and trouser legs to put arms and legs of the child into, an open chest area, and a hood. Such currently preferred embodiment is made of two layers that are kept together by snaps. The inside layer can be removed and only the outside layer used if weather permits. The blanket attaches across the top of the hood (desirably by color-coordinating snaps) and can be quickly flipped down to cover the face and chest.

The Car Seat Coat is a seasonal coat that allows a child to keep warm in cool and cold weather. It allows parents to quickly and easily put their child in the coat and transport them to and from the car since there are typically no zippers or buckles. It also provides a safe way to keep a child warm in the car since the open chest allows for the car seat's safety seatbelt straps to fit safely and snugly across the chest. To regulate the child's temperature inside the car, the blanket can be flipped back and the child's arms taken out of the sleeves, all while the child remains safely buckled in the car seat.

The Car Seat Coat can be used in the same manner as described above for strollers, soft and structured carriers, shopping carts, bike carriers, and wagons. The Car Seat Coat provides a safe and easy way to keep a baby or toddler warm when going to and from the car and while strapped in the car seat.

BRIEF DESCRIPTION OF THE DRAWINGS

In the drawings, which illustrate what are currently considered to be the best modes for carrying out the invention.

DETAILED DESCRIPTION OF THE ILLUSTRATED EMBODIMENTS

Reference will now be made to the drawings in which the various elements of the illustrated embodiments will be given numerical designations and in which the invention will be discussed so as to enable one skilled in the art to make and use the invention. It is to be understood that the following description is only exemplary of the principles of the present invention, and should not be viewed as narrowing the claims which follow.

Figure 1:
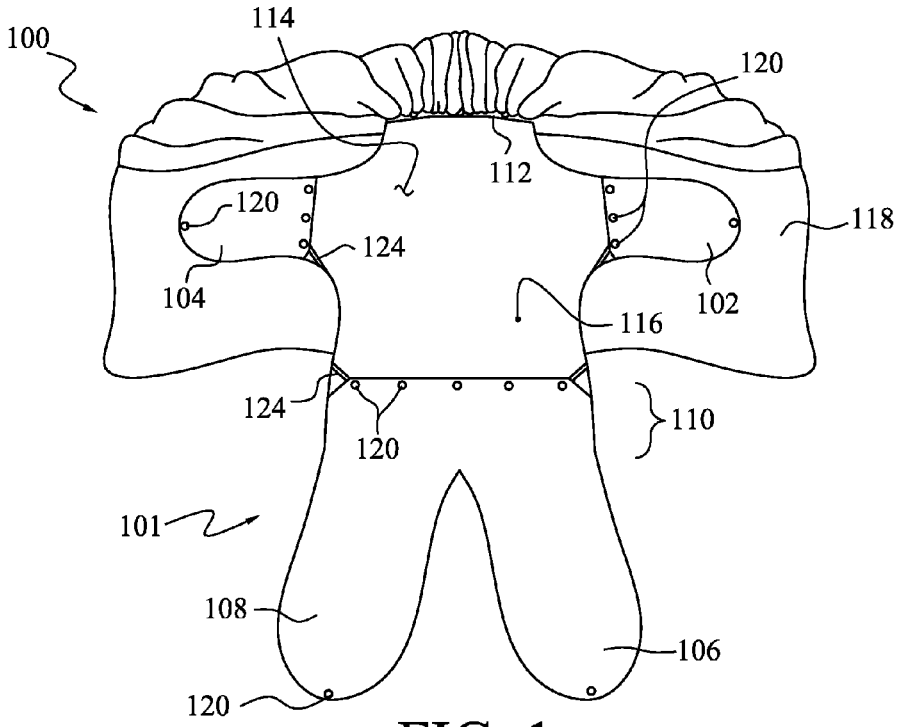
FIG. 1 is a plan view of a currently preferred embodiment of a car seat coat structured according to certain principles of the instant invention.

A currently preferred embodiment of a car seat coat, generally 100, is illustrated in FIG. 1. Car seat coat 100 includes a jump-suit, generally 101, including left and right sleeves, 102, 104, respectively, and left and right legs, 106, 108, respectively. Desirably, a short section of pants 110, is provided at the tops of legs 106, 108. A hood 112 is typically connected to a back panel 114. The perimeter cooperatively formed by the illustrated hood, sleeves, and legs leaves an always-open area 116 that is structured to resist trapping material of the car seat coat 100 between the chest of a child and retaining straps of a seat belt harness.

A blanket 118 is generally provided to form an optional covering over at least substantially the entire always-open area 116. As illustrated in FIG. 1, it is currently preferred to anchor an edge of the blanket 118 to the front visor area of hood 112. However, it is within contemplation to anchor a blanket to alternative areas, including any convenient and operable portion of the jump-suit 101. Sometimes, one or more corner of the blanket 118 may be anchored to a posterior portion of the jump-suit 101, such as at a fastener disposed at the back of the hood 112, to further promote a "tent" effect, and to better wrap one or more blanket edge around the child.

Desirably, blanket 118 is removably anchored to permit use of blanket 118 for alternative functions, such as a blanket, nursing cover, and diaper-changing surface, as non-limiting examples. In certain currently preferred embodiments, blanket 118 is removably attached to a visor brim of hood 112 using a plurality of snaps 120. The preferred snaps 120 include color-coded resin snaps to distinguish between blanket snaps and snaps for the inner and outer layers (described in more detail below). Alternative fastening arrangements within contemplation include one or more hook-and-loop fastener, button, zipper, magnetic catch, hook and aperture, and any other structure effective to hold the blanket in association with a portion of the jump-suit 101. Of course, blanket 118 may simply be stitched, or otherwise permanently secured, directly to a portion of jump-suit 101.

Figure 3:
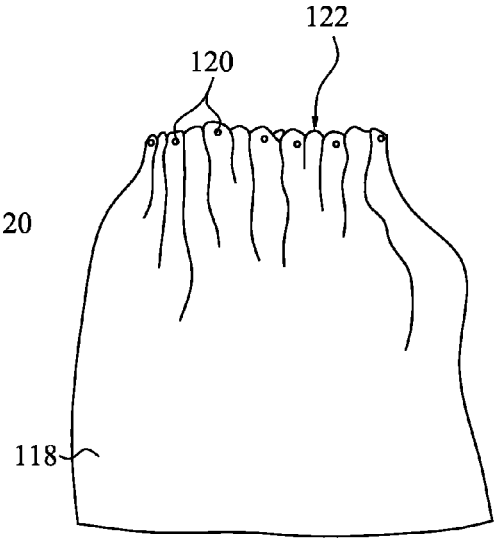
FIG. 3 is a plan view of a blanket portion of the embodiment illustrated in FIG. 1.

As illustrated in FIG. 3, it is preferred to apply a portion of pre-stretched elastic material to an edge 122 of blanket 118 to assist in bunching that material effective to hold the blanket 118 in agreement with the shape of a child. Such bunched material is effective to make a better heat-trapping tent when the blanket is placed over the always-open area 116, and helps to keep the child warm. In currently preferred embodiments, stretches of elastic are used to retain sleeve and leg flaps, and pre-bunch an edge of the blanket 118, respectively.

With reference again to FIG. 1, sometimes provision is made to assist in placing a child into the car seat coat 100. For example, elastic cord 124 (e.g. ¼-inch elastic) may be included in association with an opening to a sleeve or a leg to assist in expanding such opening to place a child into the car seat coat 100. The elastic cord 124 stretches to form an expanded opening to accommodate insertion of an arm or leg, then urges the expanded opening toward a closed position.

Figure 2:
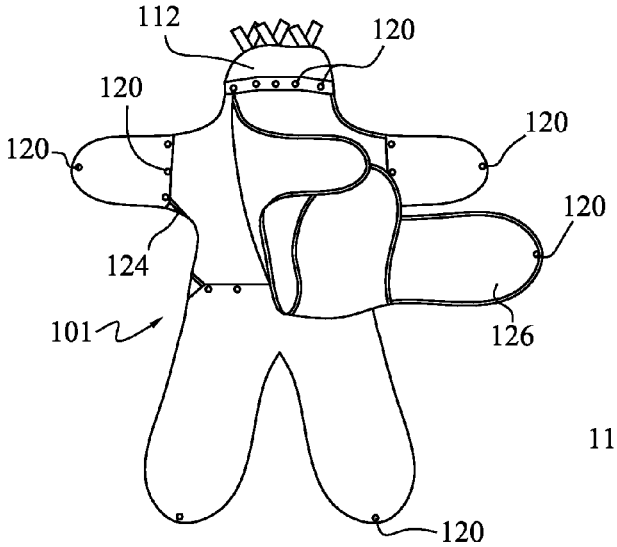
FIG. 2 is a plan view of the embodiment illustrated in FIG. 1, in a partially assembled condition.

It is within contemplation to provide a variable amount of insulation to a child who is wearing a car seat coat 100. For example, a car seat coat 100 may include a plurality of insulating layers, with a desired number of layers being selected to accommodate a current temperature. FIG. 2 illustrates a second layer, liner 126, that is illustrated as being partially installed inside jump-suit 101. Liner 126 is structured substantially in accordance with jump-suit 101, and is sized for insertion inside it as a liner layer providing additional insulation. Several such liner layers may be provided, as desired. One or more fastener, such as snaps 120, may be included to keep the plurality of edges of material at the leg and arm openings in registration, or to assist in keeping distal ends in an installed position.

Figure 4:
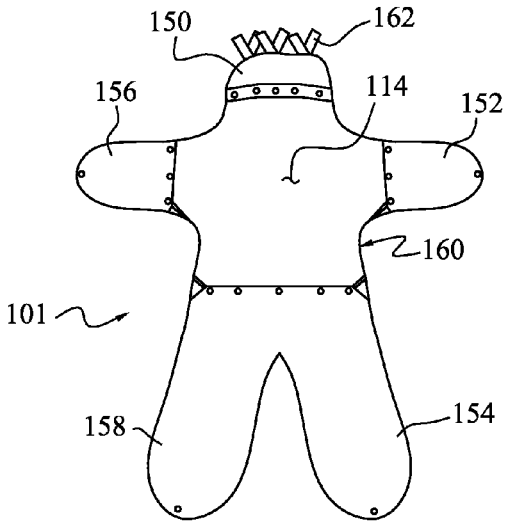
FIG. 4 is a plan view of the front of a jump-suit portion of the embodiment illustrated in FIG. 1.
Figure 5:
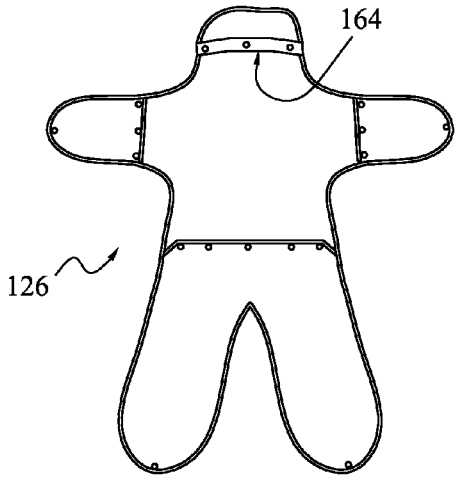
FIG. 5 is a plan view of the front of a liner portion of the embodiment illustrated in FIG. 1.
Figure 6:
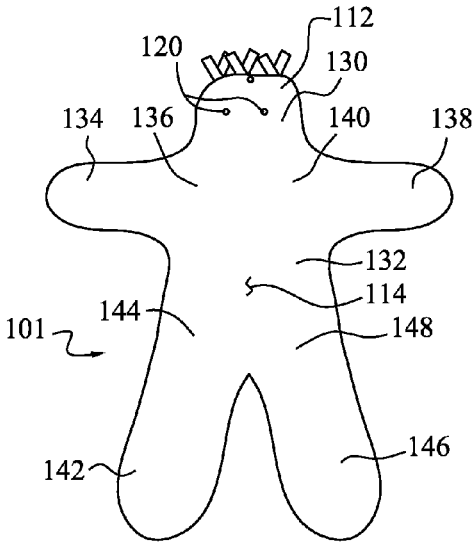
FIG. 6 is a plan view of the back of a jump-suit portion of the embodiment illustrated in FIG. 1.

Reference will now be made to FIGS. 4 through 7, which illustrate certain details of construction of the currently preferred embodiment of a car seat coat 100 illustrated in FIG. 1. With particular reference to FIG. 6, jump-suit 101 includes back panel 114 that is formed in the general outline of a human child. Back panel 114 includes a head 130 connected to the top of an abdomen 132, a left arm 134 connected to the left shoulder 136 of the abdomen, a right arm 138 connected to the right shoulder 140 of the abdomen, a left leg 142 connected to the left hip 144 of the abdomen, and a right leg 146 connected to the right hip 148 of the abdomen.

With particular reference now to FIG. 4, a visor 150 is associated with 130 head effective to form a hood. A first left panel 152 is associated with left arm 134 effective to form a left sleeve. A second left panel 154 is associated with left leg 142 to form a left trouser-leg. A first right panel 156 is associated with right arm 138 effective to form a right sleeve. A second right panel 158 is associated with right leg 146 to form a right trouser-leg. Note that the perimeter associated in combination with left sleeve, right sleeve, left trouser-leg, and right trouser-leg is structured to provide always-open area disposed in correspondence with a chest area of car seat coat 100.

Sometimes, ornamental structure, such as a plurality of tassels 162, may be included in a jump-suit 101. Also, by comparing FIGS. 4 and 5, notice that selected fasteners 120 interface between visor 150 and edge 164 of liner 126. Other remaining fasteners 120 are used to affix the blanket 118. That is, certain snaps 120 are arranged to couple inside, between the jump-suit 101 and liner 126. Other fasteners 120 are arranged to couple outside, between jump-suit 101 and blanket 118. Desirably, the snaps 120 are interchangeable so blanket 118 can be snapped in a variety of ways including backwards if another layer of warmth is needed when the child is held in a chest-to-chest position, i.e. in a soft carrier.

Figure 7:
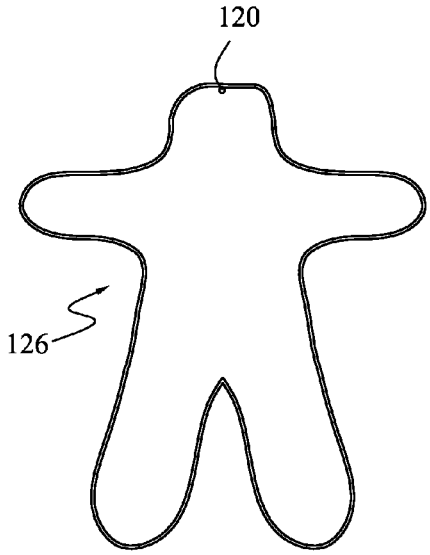
FIG. 7 is a plan view of the back of a liner portion of the embodiment illustrated in FIG. 1.

Currently preferred construction of liner 126 is illustrated in FIGS. 5 and 7. Liner 126 is structured substantially in agreement with jump-suit 101, although the sewn seams may be simply placed inboard of the cut edge of material from which the liner is made, as illustrated. In contrast, the jump-suit 101 is turned right-side-out subsequent to forming a seam that attaches left and right panels to back panel 114. Also, sometimes one or more fastener, such as a snap 120, may be positioned cooperatively between the liner and jump-suit 101 to hold the liner's hood in registration inside the jump-suit's hood 112 (see FIGS. 6 and 7).

Figure 8:
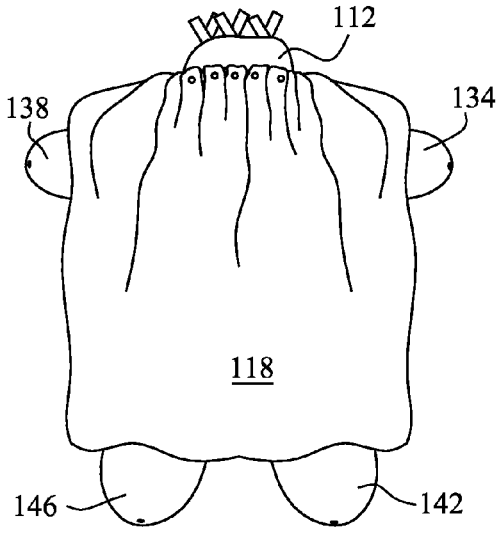
FIG. 8 is a plan view of the embodiment illustrated in FIG. 1, with the blanket drawn over the front of the jump-suit.
Figure 9:
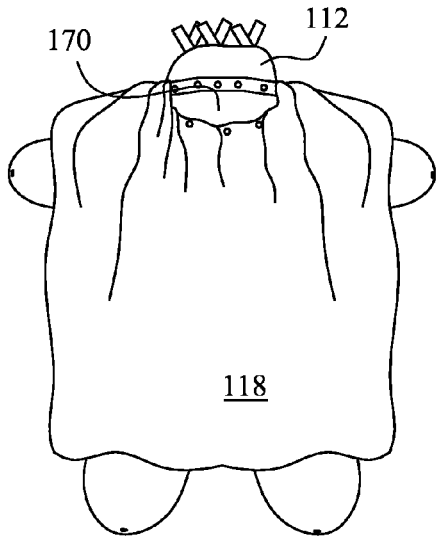
FIG. 9 is a view similar to FIG. 8.
Figure 10:
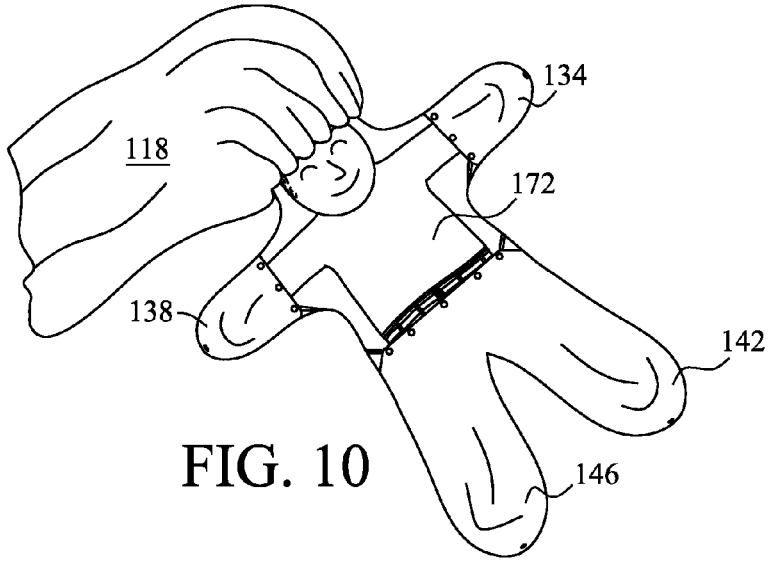
FIG. 10 is a front view in perspective of a child wearing the embodiment illustrated in FIG. 1.

FIGS. 8 through 10 illustrate a few of the variety of anchoring that may sometimes desirably be effected between a jump-suit 101 and a blanket 118. In FIG. 1, the blanket is affixed across the entire edge of the hood 112, thereby forming a warm and substantially sealed tent. It should be noted that additional fasteners (not illustrated) may be disposed to assist in keeping edges of the blanket 118 tucked-in around a child in a car seat. In FIG. 9, the central stretch of the blanket anchor at hood 112 is un-attached, thereby forming an aperture 170 through which a child may peer out from inside the car seat coat 100. FIG. 10 illustrates the blanket 118 being folded back and away from covering the child 172.

Figure 11:
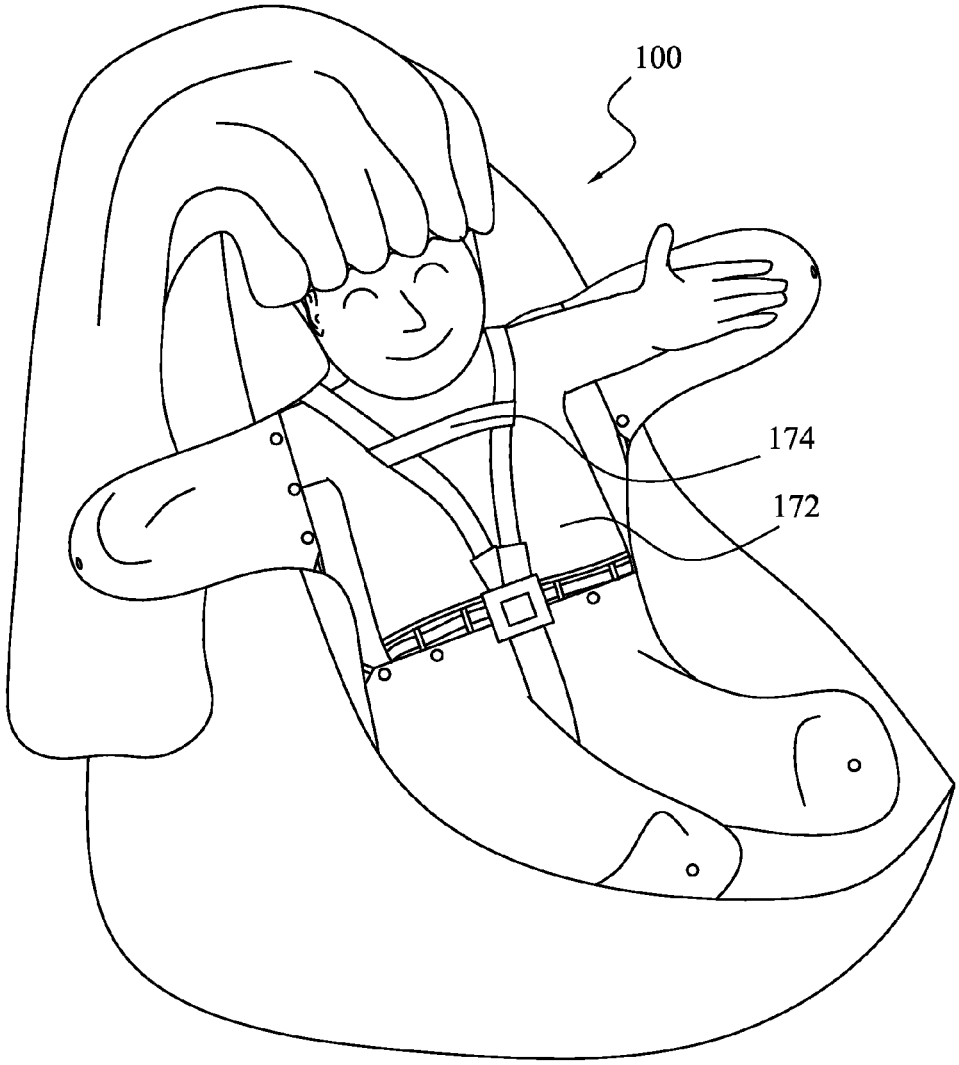
FIG. 11 is a view similar to FIG. 10.

Preferred embodiments permit a great deal of flexibility to regulate the temperature of a child wearing the car seat coat. Desirably, temperature regulation may be effected while the child remains strapped into the car seat. FIG. 11 illustrates an additional degree of flexibility in the amount of covering that may be applied to a child by the car seat coat 100. A child may have one or both hands out from engagement in one or more sleeve, if temperature conditions warrant. Notice in FIG. 11 that the car seat coat 100 is configured and arranged such that retention straps 174 do not compress material of the car seat coat between the straps 174 and the chest of the child 172 in the car seat.

Figure 12:
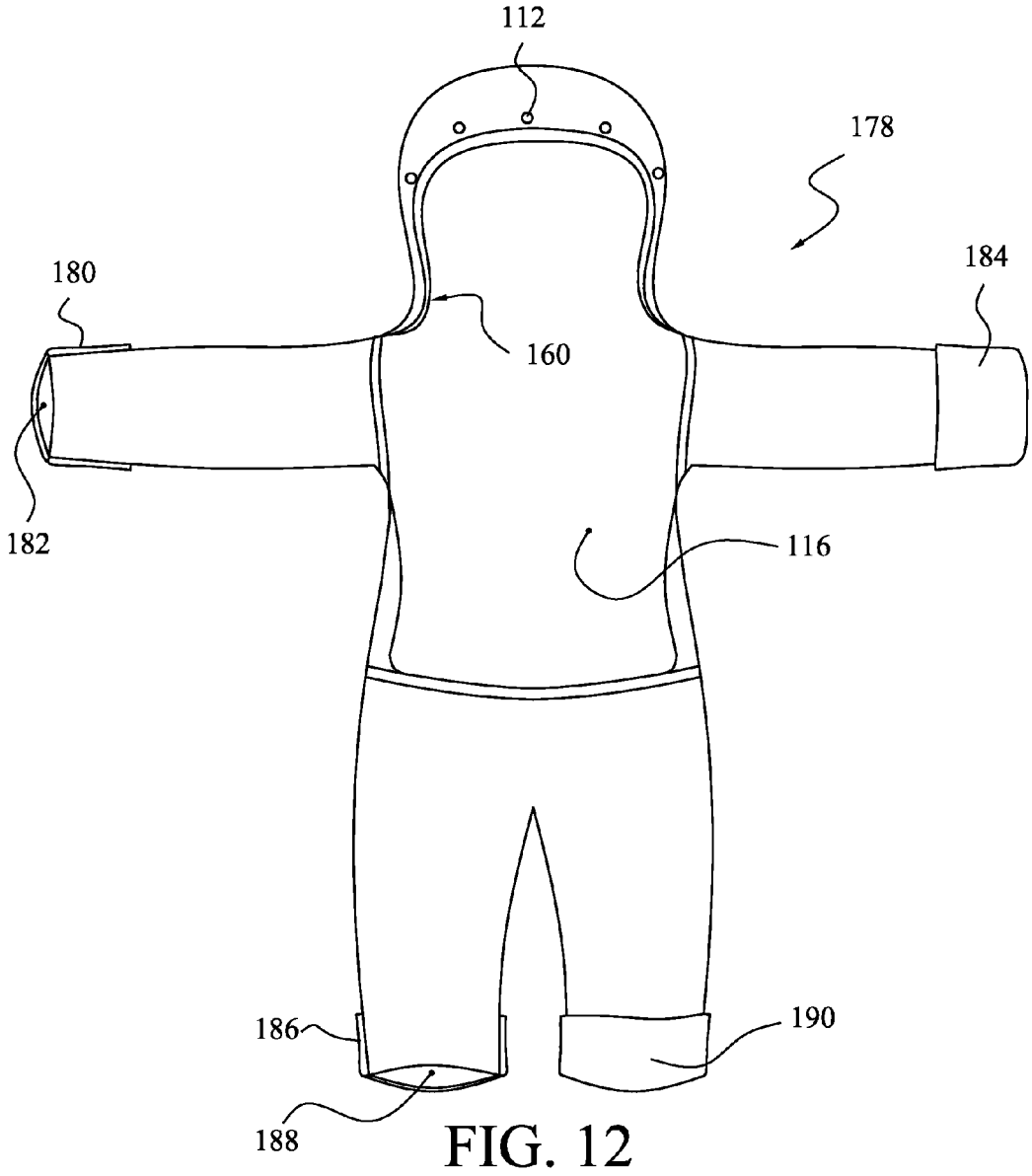
FIG. 12 is an alternative embodiment of a car seat coat structured according to certain principles of the instant invention.

The currently preferred embodiment of car seat coat 100 may be manufactured in a variety of sizes to accommodate children, from infants through toddlers, who must ride in a car seat during periods of cold weather. After a child begins to walk, the alternative embodiment of a car seat coat, generally indicated at 178 in FIG. 12, may be more suitable. Car seat coat 178 is structured substantially similarly to embodiment 100, although with a more fitted hood 112 and arm and leg appendages. Car seat coat 178 includes an always-open area 116 to resist trapping material of car seat coat 178 between the straps of a seat-belt and the chest of a child. It is currently preferred to include a pre-stretched elastic disposed at the perimeter 160 of open area 116, to assist in keeping portions of the coat 178 drawn toward the child, and to help coat 178 remain on a walking child.

Certain embodiments of a car seat coat 178 may include permanently closed arm and leg ends. However, it is currently preferred to provide open ends through which a child may extend his/her feet and hands. As illustrated, it is most preferred to provide closable structure, such as cuffs that can be placed either in an end-open configuration, or in an end-closed configuration. Right arm cuff 180 is illustrated in an end-open configuration to permit a child's right hand to exit opening 182. In contrast, left arm cuff 184 is illustrated in an end-closed position. Cuffs 180, 182 are anchored only at top and bottom of their associated sleeve to permit rearranging a cuff between open- and closed-ended configurations. To create the end-closed configuration, the cuff 184 has simply been everted, and drawn from the back side of the coat 200 to the front side. Such an end-closed position may avoid need for a child to wear gloves, or mittens, while riding in a car seat.

Similar to the illustrated closable arm structure, right leg cuff 186 is illustrated in an end-open configuration to permit a child's right foot to exit opening foot 188. Left leg cuff 190 is illustrated in an end-closed position. It is within contemplation to include elasticized end openings of sleeves and/or legs to assist in maintaining the coat on a child. Also, elasticized openings may facilitate installation of the coat 178 on a child by temporarily permitting expansion of the opening to accommodate passage therethrough of a mitten or boot. The leg cuffs 186 and 190 provide the option for a child to not require boots while riding in a car seat.

A cooperating blanket for use with coat 178 may be structured substantially similarly to blanket 118. Alternatively, anchor structure, such as one or more snap, may be disposed substantially at the corners of an edge. Of course, and similarly to embodiment 100, the cooperating blanket may be anchored with respect to coat 178 in any desired number of places, and at any operable location(s), to cause any desired amount of wrapping, or bundling, of the enclosed child. A preferred anchor arrangement permits the blanket to be worn like a cape by a walking child. Portions of the cooperating blanket may even be tucked into the leg cuffs as a child is walking.

Detailed description of donning/doffing the coat: Start with the Car Seat Coat 100 assembled with the desired number if insulating layers. Lay the coat 100 down on a surface on its back. The blanket should be attached to the hood and lying spread out above the coat 100. (see FIG. 10). Set the child on its back on top of the coat 100. Bend the child's arms and legs and place each in the appropriate sleeve and/or trouser leg, respectively. The elastic 124 at the corners of the sleeve and trouser leg keeps the sleeve and trouser leg snug and the separation makes it easy to place the limbs (see FIG. 10). Position the child's head inside the hood 112 and bring the blanket 118 over top of the child as a covering. Wrap the blanket 118 from the front around to the child's back while picking them up. The child is ready to go outside and will be completely protected from the elements (see FIG. 8). Another option includes unsnapping the fasteners to expose the face. This can be done in milder temperatures when complete protection from the elements is not needed (see FIG. 9). If the face needs to be quickly covered, the elastic in the blanket 118 will keep the blanket 118 up on the hem of the hood without needing to snap it. It is not as secure but works for quick adaptations.

When ready to take the child out of the coat, reverse the steps. Lay the child down on his/her back. Flip the blanket 118 back and bend each arm and leg to take each out of the corresponding sleeve or trouser leg. Then pick the child up. Other options include flipping the blanket back but leaving the child in the coat if they are sleeping. If regulation of the child's temperature is needed, the blanket may be flipped back, and the child's s may be taken out of the sleeves without waking the child.

Detailed description of using the coat in the car seat: Put the child in the coat 100 as described above. Place them in their car seat and flip the blanket 118 back over the back of the car seat. Put the car seatbelt straps on as usual. Note the narrow neck inherent in, or permitted by construction of, the car seat coat 100 allows for the car seat seatbelt straps to fit squarely over the child's shoulders. The straps 174 should fit snugly on the child's chest according to each specific manufacturer's instructions. If desired, the blanket 118 can be brought back down over the child to keep them warm, the arms can be taken out of their sleeves, and/or the blanket 118 can be left over the back of the car seat (see FIG. 11). This allows for the ability to regulate the child's temperature depending on the temperature of the vehicle. There is also another option of leaving the blanket down over the child when donning the car seat seatbelt straps. By donning the car seat seatbelt straps underneath the blanket 118, it allows the child to stay protected from the elements while strapping them into the seat. This can be helpful if the car door needs to be open or if the vehicle is very cold.

Operable materials for use in manufacture of a workable car seat coat include a variety of fabrics, such as flannel, fleece, sherpa, quilting, and other fabric and insulation combinations. It is currently preferred to use fleece, due to its inherent insulating properties, and the commercial availability of fleece in a variety of pleasing colors and patterns. A sewing machine is used to combine the fabric material(s) and a snap press to apply the snaps.

The Car Seat Coat can be used in strollers, soft and structured carriers, shopping carts, bike carriers, and wagons. The Car Seat Coat provides a safe and easy way to keep a baby or toddler warm when going to and from the car and while strapped in the car seat.

While the invention has been described in particular with reference to certain illustrated embodiments, such is not intended to limit the scope of the invention. The present invention may be embodied in other specific forms without departing from its spirit or essential characteristics. The scope of the invention is, therefore, indicated by the appended claims. All changes which come within the meaning and range of equivalency of the claims are to be embraced within their scope.

What is claimed is:

1. A first suit of clothing, for a human child, comprising:

a back panel having a length sized in general agreement with an abdomen of said child;

a left sleeve associated with a left shoulder area of said back panel, said left sleeve comprising a permanent tunnel structured to accommodate insertion therein of a left arm of said child;

a right sleeve associated with a right shoulder area of said back panel, said right sleeve comprising a permanent tunnel structured to accommodate insertion therein of a right arm of said child;

a left leg associated with a left hip area of said back panel;

a right leg associated with a right hip area of said back panel;

a hood configured to accommodate the head of said child, a bottom of said hood being associated with a top of said back panel; and a first perimeter comprising:

a first stretch extending downwardly from said left shoulder area; and a second stretch extending downwardly from said right shoulder area, said first stretch and said second stretch being permanently spaced apart to provide an always-open chest area of said first suit of clothing, said always-open chest area extending downward from the neck at least through the pectoral area of said child; and wherein:

a portion of an edge of a blanket is removably affixed to a perimeter of said hood.

2. The first suit of clothing of claim 1, further comprising:

a blanket affixed to said first suit of clothing, said blanket being configured and arranged for optional disposition to at least substantially cover said always-open chest area.

3. The first suit of clothing of claim 2, wherein:

said blanket is removably affixed to said first suit of clothing.

4. The first suit of clothing of claim 1, in combination with:

a second suit of clothing structured substantially in accordance with said first suit of clothing and sized for insertion inside said first suit of clothing as a liner layer providing additional insulation.

5. The first suit of clothing of claim 1, wherein:

said always-open chest area is sized for correspondence with at least substantially the entire chest area of said first suit of clothing.

6. The first suit of clothing of claim 1, wherein:

said always-open chest area is sized and arranged to permit fastening retention straps of a seatbelt of a car seat, effective to secure a child that is wearing said first suit of clothing in said car seat, without trapping material of said first suit of clothing between said retention straps and the chest area of said child.

7. The first suit of clothing of claim 1, wherein:

the distal ends of said left sleeve and said right sleeve are permanently closed.

8. The first suit of clothing of claim 1, wherein:

the distal ends of said left sleeve and said right sleeve are optionally closable.

9. The first suit of clothing of claim 8, wherein:

a cuff disposed proximal to an end of an sleeve is configured and arranged to provide either an open-ended sleeve, or a closed sleeve.

10. The first suit of clothing of claim 1, wherein:

the distal ends of said left leg and said right leg are permanently closed.

11. The first suit of clothing of claim 1, wherein:

the distal ends of said left leg and said right leg are optionally closable.

12. The first suit of clothing of claim 11, wherein:

a cuff disposed proximal to an end of a leg is configured and arranged to provide either an open-ended leg, or a closed leg.

13. The first suit of clothing of claim 2, wherein:

said blanket may be variably secured to said first suit of clothing such that:

at a first anchoring configuration, the face of said child may be fully covered by clothing structure comprising said blanket; and at a second anchoring configuration, an opening is formed such that said face is exposed at least sufficiently to permit said child to peer out from under said blanket.

14. The combination of claim 4, further comprising:

a first fastener arrangement disposed in association with a first portion of said first perimeter and a cooperation second portion of said second suit of clothing, said first fastener arrangement being operable to resist separation between said first and second portion to facilitate insertion of an arm of said child into reception inside a sleeve of said second suit of clothing.

15. The combination of claim 4, further comprising:

a second fastener arrangement disposed in association with a third portion of said first perimeter and a cooperation fourth portion of said second suit of clothing, said second fastener arrangement being operable to resist separation between said third and fourth portion to facilitate insertion of a leg of said child into reception inside a leg of said second suit of clothing.

16. The combination of claim 4, further comprising:

a fastener arrangement operable to maintain a distal end of a sleeve or a leg of said second suit of clothing registered in an installed position in inside said first suit of clothing.

17. A car seat coat, comprising:

a back panel having a perimeter formed in the general outline of a human child, and including a head connected by a neck to the top of an abdomen, a horizontally outstretched left arm connected to the left shoulder of said abdomen, a horizontally outstretched right arm connected to the right shoulder of said abdomen, a left leg connected to the left hip of said abdomen, and a right leg connected to the right hip of said abdomen;

a visor associated with said head effective to form a hood;

a first left front panel affixed to said left arm effective to form a left sleeve comprising a tubular length in which to accommodate a portion of an arm of a child;

a second left front panel affixed to said left leg to form a left trouser-leg;

a first right front panel affixed to said right arm effective to form a right sleeve comprising a tubular length in which to accommodate a portion of the other arm of said child; and a second right front panel affixed to said right leg to form a right trouser-leg; wherein:

a first perimeter associated in combination with said left sleeve, right sleeve, left trouser-leg, and right trouser-leg is structured to provide an always-open chest area of said car seat coat, said always-open chest area being structured to expose at least the pectoral region of said child; and a space is provided between the proximal termination of each said sleeve and said neck to permit draping a strap over a shoulder of a wearer without trapping material of a sleeve between the strap and the chest of said wearer; and further comprising:

a blanket structured for removable attachment to said hood, said blanket being configured and arranged for optional disposition to at least substantially cover said always-open chest area.

* * * * *